US010512591B2

(12) United States Patent
Oshgan et al.

(10) Patent No.: US 10,512,591 B2
(45) Date of Patent: Dec. 24, 2019

(54) CARTRIDGE ASSEMBLY FOR AN INJECTION SYSTEM

(71) Applicant: Hospira, Inc., New York, NY (US)

(72) Inventors: Robert John Oshgan, Wauconda, IL (US); John C. Tanner, II, Lake Bluff, IL (US)

(73) Assignee: Hospira, Inc., Lake Forest, IL (US)

( * ) Notice: Subject to any disclaimer, the term of this patent is extended or adjusted under 35 U.S.C. 154(b) by 0 days.

(21) Appl. No.: 15/807,310

(22) Filed: Nov. 8, 2017

(65) Prior Publication Data

US 2018/0125758 A1 May 10, 2018

Related U.S. Application Data

(62) Division of application No. 14/136,779, filed on Dec. 20, 2013, now abandoned.

(60) Provisional application No. 61/747,483, filed on Dec. 31, 2012.

(51) Int. Cl.

| | |
|---|---|
| ***A61J 1/20*** | (2006.01) |
| ***A61J 1/14*** | (2006.01) |
| *A61J 1/06* | (2006.01) |

(52) U.S. Cl.

CPC ..... *A61J 1/2096* (2013.01); *A61J 1/1406* (2013.01); *A61J 1/062* (2013.01); *A61J 1/201* (2015.05); *Y10T 29/49826* (2015.01)

(58) Field of Classification Search

CPC ..... A61J 1/2096; A61J 1/1406

See application file for complete search history.

(56) References Cited

U.S. PATENT DOCUMENTS

| | | | | |
|---|---|---|---|---|
| 4,581,023 | A | 4/1986 | Kuntz | |
| 4,909,794 | A | 3/1990 | Habert et al. | |
| 4,935,014 | A | 6/1990 | Haber | |
| 5,207,983 | A | 5/1993 | Liebert et al. | |
| 5,354,287 | A | 10/1994 | Wacks | |
| 5,358,491 | A | 10/1994 | Johnson et al. | |
| 5,364,369 | A * | 11/1994 | Reynolds | A61J 1/2089 604/187 |
| 5,389,086 | A | 2/1995 | Attermeier et al. | |
| 5,405,326 | A | 4/1995 | Haber et al. | |
| 5,451,214 | A | 9/1995 | Hajishoreh | |
| 5,501,676 | A | 3/1996 | Niedospial et al. | |

(Continued)

FOREIGN PATENT DOCUMENTS

WO 2009/061315 A1 5/2009

*Primary Examiner* — Regina M Yoo

(74) *Attorney, Agent, or Firm* — Michael R. Crabb

(57) ABSTRACT

Methods and systems for a cartridge assembly for use with an injection system are provided. An example cartridge assembly may include an ampule containing a pharmaceutical product that is sealed at a distal end with a pierceable diaphragm. The cartridge assembly may also include a hub comprising a proximal portion defining a cavity that is configured to engage the distal end of the ampule and a piercing member positioned within the cavity. The piercing member may include a fluid pathway between a proximal end portion comprising an opening and a distal end in fluid communication with a distal opening of the hub. The proximal end portion may engage the pierceable diaphragm, and the piercing member may apply a force to the pierceable diaphragm in the inactivated position without penetrating the pierceable diaphragm.

16 Claims, 6 Drawing Sheets

(56) References Cited

U.S. PATENT DOCUMENTS

| | | | | |
|---|---|---|---|---|
| 5,526,853 | A | 6/1996 | McPhee et al. | |
| 5,554,125 | A * | 9/1996 | Reynolds | A61J 1/062 604/187 |
| 5,653,698 | A | 8/1997 | Niedospial et al. | |
| 5,700,246 | A | 12/1997 | Stiehl et al. | |
| 5,817,082 | A | 10/1998 | Niedospial et al. | |
| 6,022,339 | A * | 2/2000 | Fowles | A61J 1/10 604/411 |
| 7,563,253 | B2 | 7/2009 | Tanner et al. | |
| 8,328,772 | B2 | 12/2012 | Kinast et al. | |
| 2001/0000793 | A1 | 5/2001 | Daubert et al. | |
| 2005/0075602 | A1 | 4/2005 | Cherif-Cheikh et al. | |
| 2005/0137566 | A1* | 6/2005 | Fowles | A61J 1/1406 604/412 |
| 2008/0287881 | A1 | 11/2008 | Kiehne et al. | |
| 2008/0300570 | A1* | 12/2008 | Fowles | A61J 1/1406 604/410 |
| 2009/0326412 | A1 | 12/2009 | Pakter | |
| 2011/0282298 | A1 | 11/2011 | Agian et al. | |
| 2012/0078214 | A1 | 3/2012 | Finke et al. | |
| 2012/0330267 | A1 | 12/2012 | Domkowski et al. | |
| 2013/0110053 | A1 | 5/2013 | Yoshino et al. | |

* cited by examiner

CARTRIDGE ASSEMBLY FOR AN INJECTION SYSTEM

CROSS-REFERENCE TO RELATED APPLICATION

This application claims the benefit of U.S. Provisional Application No. 61/747,483, filed Dec. 31, 2012.

FIELD OF THE INVENTION

The invention relates generally to injection systems for delivering a pharmaceutical product to a patient, and more particularly to cartridge assemblies for use with injection systems.

BACKGROUND OF THE INVENTION

Pharmaceutical products are often delivered or transferred through the use of an injection system, such as a reusable syringe system. Instead of being provided directly in the injection system, however, many pharmaceutical products in the market today are provided in a cartridge assembly that can be loaded into the injection system. Once loaded, a medical professional can activate the cartridge assembly and deliver the pharmaceutical product to the patient.

These cartridge assemblies typically include an ampule containing the pharmaceutical product and a hub. The ampule is typically closed at the proximal end with a flexible piston, and closed at the distal end with a pierceable diaphragm. The distal end is also conventionally fitted with the hub.

The hub typically features a metal piercing member at its proximal end for piercing the diaphragm of the ampule during activation of the cartridge assembly in order to access the pharmaceutical product and allow for its delivery through a delivery device connected to the distal end of the hub. The delivery device can take many forms. For example, it may include a needle of known construction, thereby enabling direct or indirect delivery of a pharmaceutical product to a patient (e.g., through intravenous injection or through a septum that fluidly seals a port associated with a tube set that is, or can be, fluidly connected to a patient). Alternatively, the delivery device can be a blunt needle that is constructed to be inserted through a pre-pierced septum of a tube set. In other instances, the delivery device can be a luer fitment (male or female, locking or not-locking) configured to mate with a complementary luer fitment of another delivery device.

Examples of known injection systems for use in combination with a cartridge assembly include the CARPUJECT® and iSecure™ systems, both of which are currently owned, marketed, and sold by Hospira, Inc. (Lake Forest, Ill.), the assignee of this application and the inventions disclosed herein. Various aspects of these systems are described in U.S. Pat. Nos. 5,653,698 and 7,563,253, both of which are and incorporated herein by reference in their entirety. While the systems that use metal cannulas for piercing a diaphragm associated with an ampule perform as intended, the inventors have identified an opportunity replace the metal cannula in order to achieve a more cost efficient design.

SUMMARY

In one aspect, the invention is directed to a cartridge assembly for use with an injection system. The cartridge assembly may include an ampule containing a pharmaceutical product that is sealed at a distal end with a pierceable diaphragm. The cartridge assembly may also include a hub comprising a proximal portion defining a cavity that is configured to engage the distal end of the ampule and a piercing member positioned within the cavity. The piercing member may include a fluid pathway between a proximal end portion comprising an opening and a distal end in fluid communication with a distal opening of the hub. The proximal end portion may engage the pierceable diaphragm. The hub may be configured to engage the ampule in an inactivated position in which the piercing member is not in fluid communication with the pharmaceutical product in the ampule and an activated position in which the proximal end portion of the piercing member is in fluid communication with the pharmaceutical product in the ampule. Further, the piercing member may apply a force to the pierceable diaphragm in the inactivated position without penetrating the pierceable diaphragm.

In another aspect, the invention is directed to a method for providing a sterilized cartridge assembly for use with an injection system. The method may include providing a sealed ampule containing a pharmaceutical product and having a pierceable diaphragm. The method may also include providing a hub comprising a plastic piercing member for piercing the diaphragm. The method may also include connecting the ampule to the hub to create the cartridge assembly without causing the piercing member to pierce the ampule. The method may also include autoclaving the cartridge assembly.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

In general, the invention is directed to a medication delivery device including a cartridge assembly having an ampule containing a medication and a pierceable seal. The device also includes a piercing member for piercing the seal and accessing the medication. The device can be sterilized by autoclave sterilization. The cartridge can use used in a conjunction with a reusable cartridge holder that allows for a medical professional to deliver medication from the ampule to the patient in a sterile manner.

As used herein, the terms "distal," "lower," and "downward" are intended to reference the end of the cartridge holder or components thereof, which would be furthest from the medical professional holding the cartridge holder during use. Conversely, the terms "proximal," "upper," and "upward" are intended to reference the end of the cartridge holder or components thereof, which would be nearest the medical professional during use.

Figure 1A:
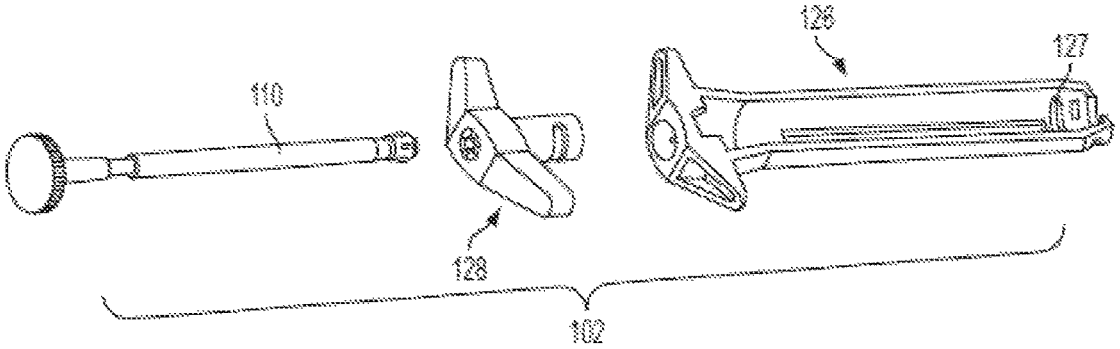
FIG. 1A is an exploded view of a cartridge holder used in conjunction with a cartridge assembly.
Figure 1B:
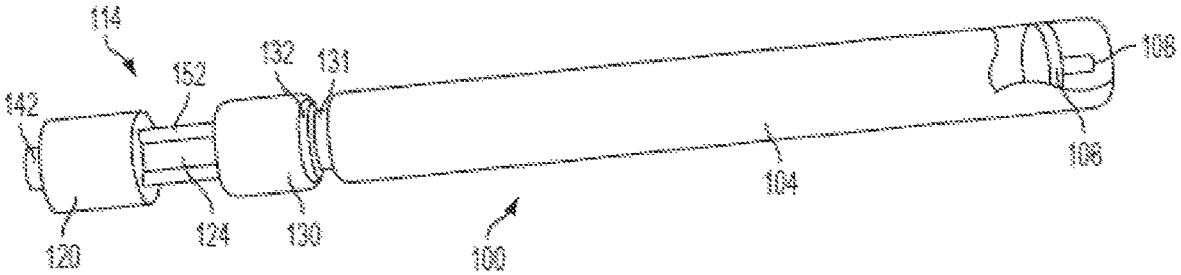
FIG. 1B is a plan view of a cartridge assembly for use with a cartridge holder.

FIGS. 1A and 1B shows an exemplary cartridge assembly 100 and an exemplary cartridge holder 102 for use therewith. The cartridge assembly 100 can be provided separately from the cartridge holder 102 such that a medical professional (e.g., a pharmacist or nurse) inserts the cartridge assembly 100 into the cartridge holder 102 prior to use. Alternatively, the cartridge assembly 100 and cartridge holder 102 can be pre-assembled by a manufacturer or assembler and supplied in combination to medical professionals.

The cartridge assembly 100 of the present invention can have a variety of configurations. In one embodiment, the cartridge assembly 100 includes an ampule 104 configured to retain a liquid pharmaceutical product. The ampule 104 can be constructed from known glass materials due to the relative inactivity between glass and most pharmaceutical products. However, it will be appreciated that in certain cases it may be appropriate or necessary to use non-glass materials due to the possible interaction between the pharmaceutical product and glass.

The proximal end of the ampule 104 is fluidly sealed with a flexible piston 106 that is configured to slide axially within the ampule 104 in order to discharge the medication from the ampule 104. The proximal side of the piston 106 is provided with a connecting member 108 that it is accessible from the exterior of the ampule 104. The connecting member 108 can have a variety of configurations, including that of a threaded rod constructed to engage complementary threads (not shown) on a plunger rod 110 of the cartridge holder 102. Alternatively, the connecting member 108 can be constructed to provide a snap fit with a complementary connecting member (not shown) on the plunger rod 110. Those skilled in the art will appreciate that the connecting member 108 can have other configurations providing locking or frictional connections with the plunger rod 110.

Figure 2A:
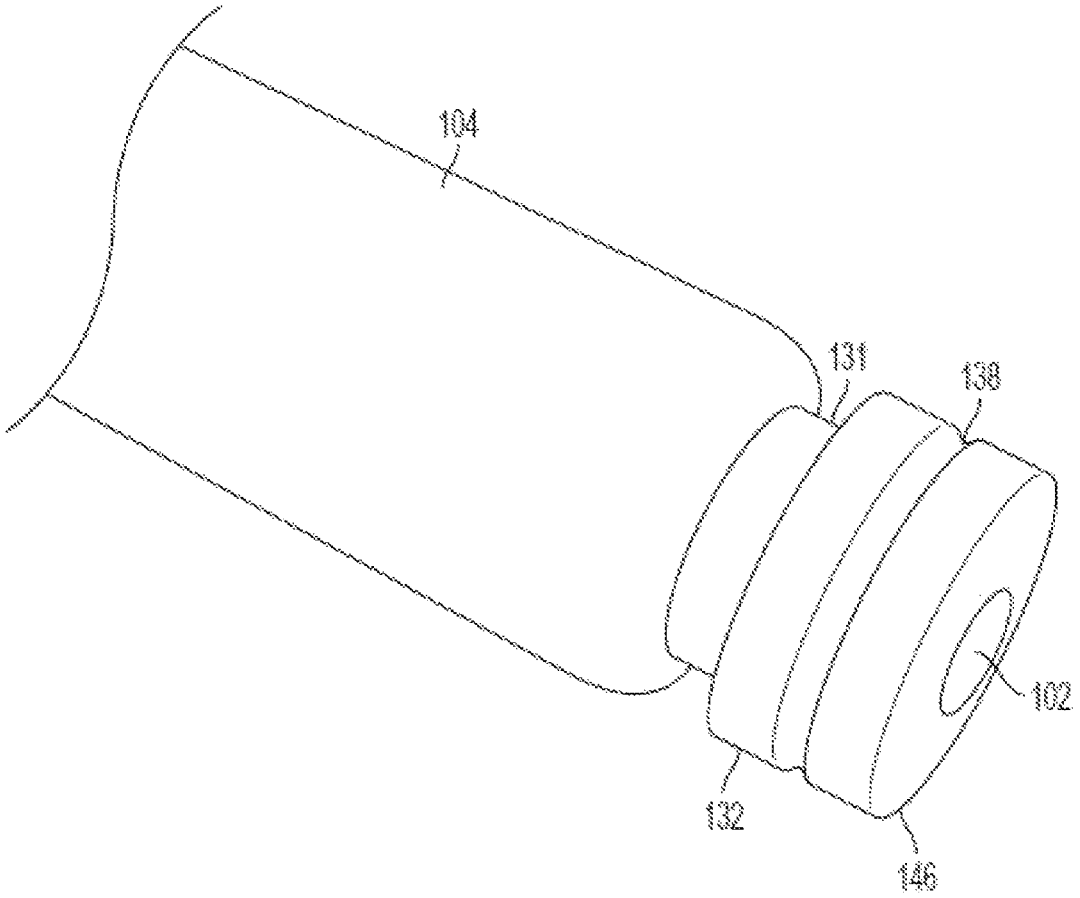
FIG. 2A is a plan view of a distal end of an ampule.

As shown in FIG. 2A, the distal end 132 of the ampule 104 is fluidly sealed by a pierceable seal, such as diaphragm 112. The seal, such as diaphragm 112, can be constructed of a variety of known materials, including elastomeric materials that do not core when a piercing member is passed therethrough. Accordingly, the seal, once punctured, should create a fluid seal around the piercing member. The seal may be held in place by any means known to those of skill in the art, including a metal end cap at the distal end 132 of the ampule. Just proximal to the distal end of the ampule is a neck-down portion 131.

Figure 2B:
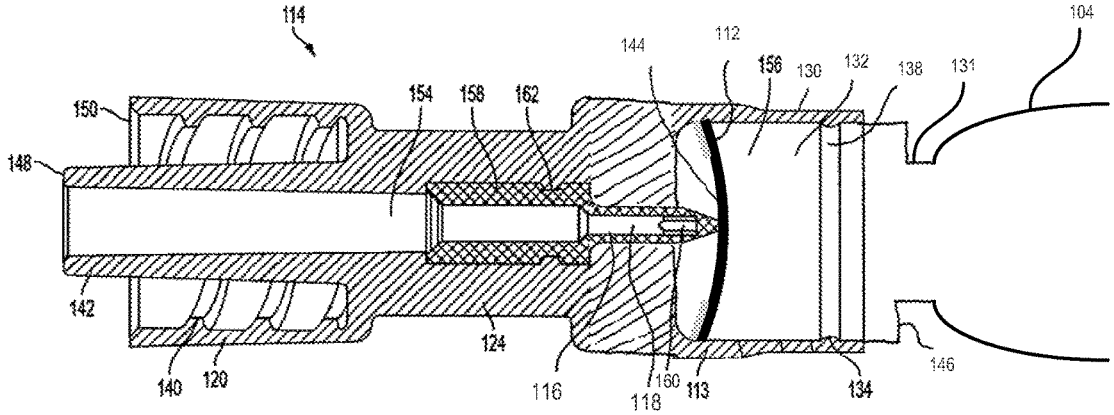
FIG. 2B is a cross section view of a hub in an inactivated position.

As shown in FIG. 2B, a plastic hub 114 has a proximal portion with an open-ended, sleeve-like cavity 130 defined by circumferential wall 113 and a distal portion defining a connecting portion 120. Cavity 130 is slidably mounted with the distal end 132 of the ampule. The hub 114 includes plastic piercing member (or cannula) 116 that is axially-mounted within the cavity and that is configured to penetrate the diaphragm 112 during activation of the cartridge assembly 100. Activation occurs when the distal end of the ampule 104 moves in the distal direction within the cavity 114, thereby causing the piercing member 116 to penetrate the diaphragm 112.

The entire hub 114, including the piercing member 116, may be constructed of a single plastic material. Alternatively, the piercing member 116 may be constructed of a different plastic material than the remainder of the hub 114. For example, the piercing member 116 may be constructed of polymethyl methacrylate, a polycarbonate, polyethylene terephthalate glycol (PETG), or an impact modified acrylic based multipolymer. The rest of the hub 114 may be constructed of, for example, polypropylene or a polyethylene based polymer (e.g., LDPE, HDPE, LLDPE). In addition, additives may be added to the plastic(s) to reduce the coefficient of friction between the components of the hub 114 and components of the ampule 104, for example, between the piercing member 116 and the diaphragm 112. As one example, the piercing member may be constructed of a polycarbonate with a silicone additive. In one embodiment, the polymers for the hub and piercing member have a tensile strength of greater than 4500 psi (31 MPa).

The piercing member 116 may be molded (e.g., injection molded) separately from the rest of the hub 114. In such an embodiment, the piercing member 116 may be press fit into the bore of the hub 114 and/or be affixed thereto using any known connection means in the art including an adhesive, threaded engagement, weld, snap fit, etc. Alternatively, the hub 114 may be manufactured using a two-shot injection molding process. In one example, the piercing member 116 is molded first and then the rest of the hub 114 is overmolded onto the piercing member 116. In another example, the hub 114 is molded first and then the piercing member 116 is overmolded onto the hub 114.

In one example, the piercing member 116 may include a necked down portion 162 (see FIG. 2B) of the piercing member 116, which results in a tongue and groove connection that prevents the piercing member 116 from moving axially relative to the rest of the hub 114. In another example, the piecing member 116 may include one or more protrusions 151A-E that are configured to fit into one or more holes 153A-D in a necked-down portion 124 of the hub 114 (see FIGS. 2D-2E). The one or more protrusions fit within the one or more holes prevent the piercing member 116 from moving axially relative to the rest of the hub 114.

Figure 2C:
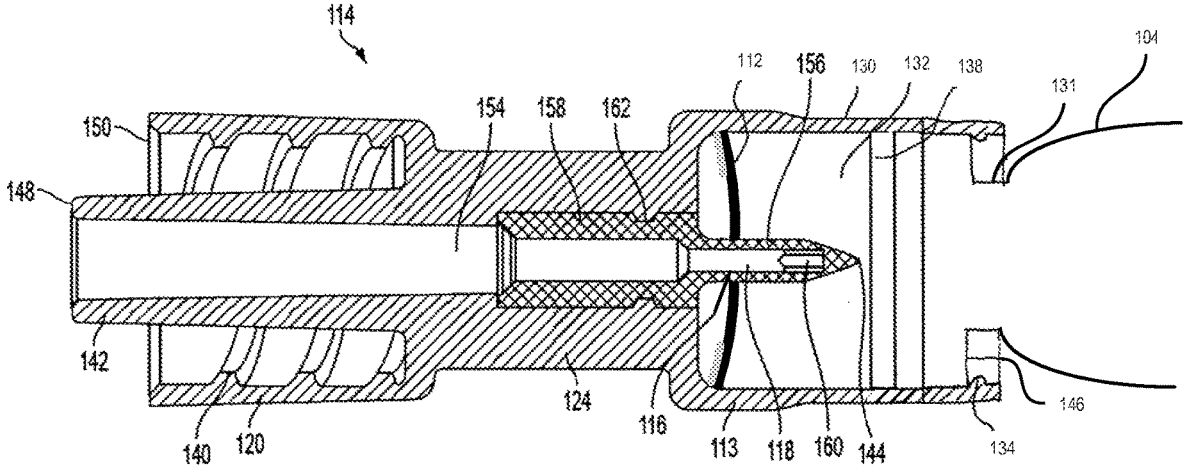
FIG. 2C is a cross section view of a hub in an activated position.
Figure 2D:
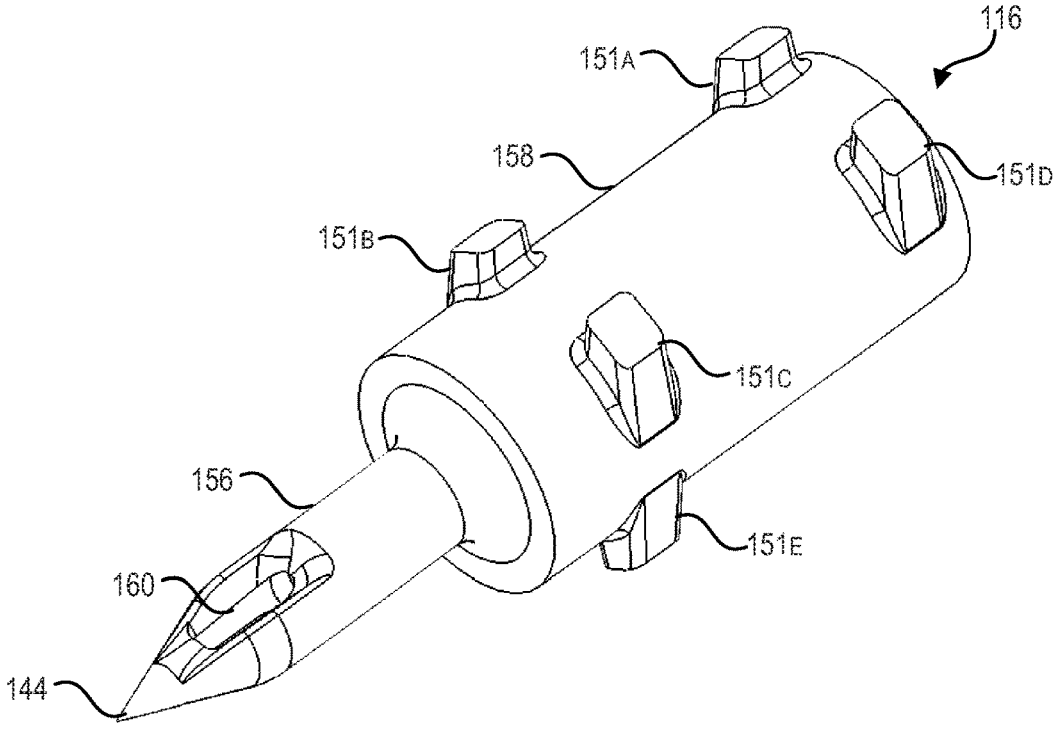
FIG. 2D is a plan view of a piercing member.
Figure 2E:
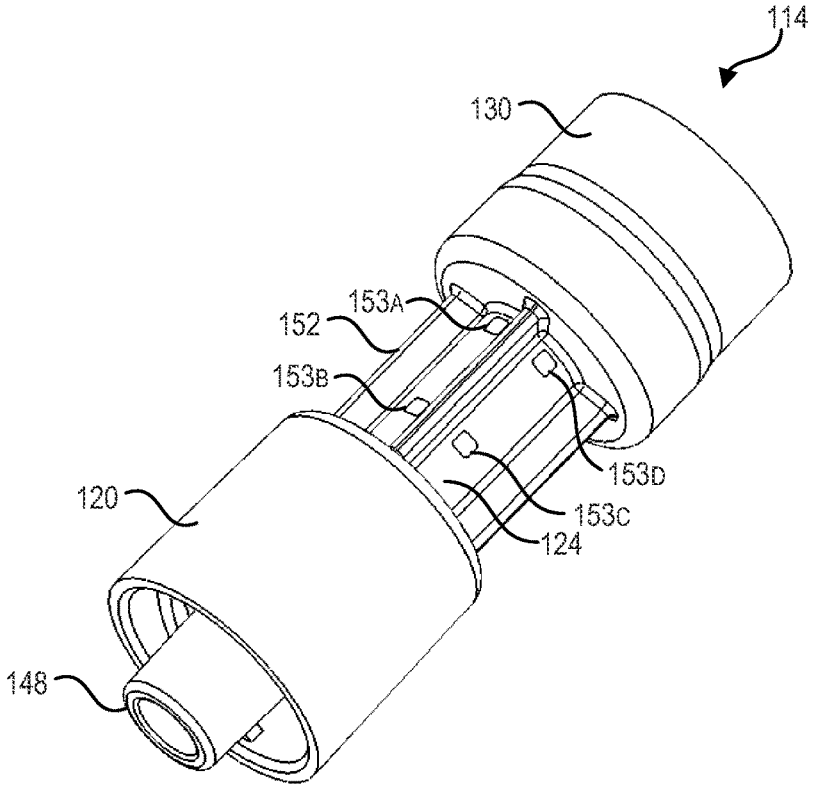
FIG. 2E is a plan view of a hub.

The hub 114 is slidable relative to the distal end 132 of the ampule 104 between a first, inactivated position in which the piercing member 116 engages but does not pierce the diaphragm 112 (as shown in FIG. 2B), and a second, activated position in which the piercing member 116 is inserted through the diaphragm 112 (as shown in FIG. 2C). In the activated position, an interior lumen 118 of the piercing member 116 is in fluid communication with the pharmaceutical product in the cavity of ampule 104. Thus, in the activated position, a fluid pathway is provided for the egress of the pharmaceutical product from the ampule 104 through the lumen of 118 of the piercing member 116 to the connecting portion 120 of the hub 114. When pressure is applied to piston 106, fluid is forced through the fluid pathway.

The distal portion 148 of the hub 114 includes a connecting portion 120 that is configured to deliver the pharmaceutical product contained in the ampule 104 directly to a patient or to another medical delivery device (e.g., a tube set configured to deliver pharmaceutical products to a patient). As shown in FIGS. 1B and 2B-2C, the connecting portion 120 may include a threaded luer member constructed to connect with a complementary luer member on a separate delivery device (not shown). It will be appreciated that the delivery device can have a variety of configurations, including, for example, (i) a hypodermic needle for delivery of pharmaceutical products directly to a patient or for indirect delivery through a pierceable septum (e.g., a pierceable septum associated with an add port of a tube set or an add port of a flexible pharmaceutical container), (ii) a blunt needle for delivery of pharmaceutical products to another medical device having the capability of receiving a pharmaceutical product from a blunt needle (e.g., a pre-slit elastomeric seal on a tube set or a flexible pharmaceutical container), (iii) threaded luer; and/or (iv) an unthreaded luer. Although the connecting portion 120 is described as being configured to connect to a variety of separate delivery devices, in other embodiments, a delivery device may be integrated into the connecting portion 120 of the hub 114. For example, instead of being a threaded luer member that can connect to a blunt needle, a blunt needle may be integrated into the connecting portion 120 of the hub 114. To ensure sterility of the cartridge assembly 100 prior to use, a cap member (not shown) may be provided in order to cover the connecting portion 120.

The hub 114 includes a necked-down portion 124 that is constructed to be positioned within a retention feature 127 of the cartridge holder 102 during use. When the cartridge assembly 100 is loaded into the injector body 126 of the cartridge holder 102, and the necked-down portion 124 is secured within the retention feature 127, the hub 114 is precluded from moving distally. Thus, a medical professional can activate the cartridge assembly 100 by manipulating (e.g., rotating) a locking member 128 in order to advance the ampule in the distal direction and apply a distally-directed force to the proximal end of the ampule 104. Because the hub 114 is precluded from moving distally, the application of a distally-directed force on the proximal end of ampule 104 causes the distal portion of the ampule 132 to slide axially within the cavity of the proximal portion of the hub 114, thereby transitioning the cartridge assembly 100 from its first, inactivated position to its second, activated position in which the piercing member 116 of the hub 114 penetrates the diaphragm 112 of the ampule 104 and places the lumen 118 of the piercing member 116 in fluid communication with the pharmaceutical product.

After the plunger rod 110 has been connected to the connecting portion 108 of the piston 106, the pharmaceutical product contained in the ampule 104 can be delivered to a patient or transferred to another medical device by the application of a distally-directed force to plunger rod 110. If desired, fluids can be aspirated into the ampule 104 at any time through the application of a proximally directed force to plunger rod 110.

As shown in FIG. 2B, the hub 114 generally includes a proximal portion 130 and a connecting portion 120, connected by a necked-down portion 124. The piercing member 116 is axially located within the cavity of the proximal portion 130 of the hub 114. As noted above, the piercing member 116 is configured to pierce the diaphragm 112 of the ampule 104 during activation of the cartridge assembly 114 (i.e., when the hub 114 and ampule 104 are brought together) and thereby access the pharmaceutical product in the ampule 104. The proximal portion 130 is also configured to receive and engage the distal end portion 132 of the ampule 104. In one embodiment, the cavity of the proximal portion 130 includes a mating member for engaging the distal end portion 132 of the ampule 104. In one embodiment, the mating member includes or is defined by a radially inwardly facing annular bead 134 within the cavity. As shown in FIG. 2B, when the cartridge assembly 100 is in the inactivated position, the bead 134 frictionally engages a complementary mating member that includes or is defined by an annular groove 138 on the distal end portion 132 of the ampule 104. This snap-type engagement helps maintain sterility of the piercing member 116 by preventing access thereto, and helps minimize or eliminate pre-mature activation of the cartridge assembly 100 by increasing the force required to move the hub 114 and ampule 104 toward one another.

As noted above, the connecting portion 120 of the hub 114 is configured to receive and engage a separate delivery device (not shown) for directly or indirectly delivering the pharmaceutical product from the cavity of the ampule 104 to the patient. In the embodiments disclosed herein, the connecting portion 120 includes a collar 150 having radially inwardly facing threads 140 and a centrally located male luer 142. As such, the connecting portion 120 is designed as a male luer-locking fitment configured to mate with a complementary female luer fitment of a delivery device. Although shown and described herein as a male luer-locking fitment, the distal connecting portion 120 may not include a locking feature, and moreover, may be replaced with a female luer fitment (locking or not-locking) configured to mate with a male luer fitment of a delivery member.

When the cartridge assembly 100 is in the inactivated position, as shown best in FIG. 2B, the piercing member 116 engages the diaphragm 112 and applies a force that pushes the center of the diaphragm away from its resting plane (i.e., the planar surface when no force is applied). The force applied by the piercing member 116 to the diaphragm 112 is maintained by the friction between the annular bead 134 and the annular groove 138 (as best shown in FIG. 2B). In one embodiment, the amount of distance that the piercing member proximally displaces the center of the diaphragm is about 0.040 inches, which reflects the amount of distance that the piercing member pushes the center of the diaphragm out of its resting plane.

Although the piercing member 116 applies a force to the diaphragm 112 in the inactivated position, the geometry and material properties of the piercing member 116 prevent the piercing member 116 from penetrating the diaphragm 112 prior to activation of the cartridge assembly 100. In other words, the force required to penetrate the diaphragm 112 is greater than the force applied by the piercing member 116 on the diaphragm 112 in the inactivated position.

When the ampule 104 and hub 114 are activated, the wall 113 defining the cavity of the proximal portion 130 of the hub 114 slides over the distal end portion 132 of the ampule 104 from the inactivated position (in which there is no fluid communication between the piercing member 116 and the pharmaceutical product) to the activated position shown in FIG. 2C, in which the piercing member 116 is in fluid communication with the pharmaceutical product in the cavity of the ampule 104. The force required to activate the cartridge assembly 100 can vary depending on design but is preferably less than 12 lbf. In one embodiment, the force required for activation is between 5-12 lbf. The force required for activation should be achievable by most medical professionals. Various factors can affect the required activation force including, for example, the hoop strength of the annular bead 134, the geometry and material properties of the piercing member 116, and the geometry and material properties of the pierceable diaphragm 112.

Once the cartridge assembly 100 is in the activated position, the annular bead 134 no longer engages the groove 138 on the distal portion 132 of the ampule 104. Instead, the annular bead 134 moves proximally with respect to the distal portion 132 of the ampule 104. Similarly, the annular groove 138 moves distally with respect to the proximal end 130 of the hub 114. The axial displacement of the bead 134 and annular groove 138 can vary. In one embodiment, after activation the bead 134 abuts a shoulder 146 at a neck-down portion 131 near the distal portion 132 of the ampule 104. Because the inner diameter of the bead 134 is less than the outer diameter of the neck down portion 131, the hub 114 is prevented from moving back in the distal direction after activation. This helps to ensure that the cartridge assembly 100 remains in the activated position until all of the pharmaceutical product is delivered to the patient. Moreover, this helps prevent pharmaceutical product from escaping into the environment do to disengagement between the ampule 104 and hub 114.

As shown in FIGS. 2B-2D, 3, and 4, the piercing member 116 generally comprises (i) a tip portion 156 for piercing and penetrating the diaphragm 112 of the ampule 104 and (ii) a base portion 158 for mounting the piercing member 116 within the bore of the hub 114. The tip portion 156 is provided with at least one opening 160 near the tip 144. The number of openings can vary depending on design. In the embodiments disclosed herein, the piercing member 116 has two openings 160.

Figure 3:
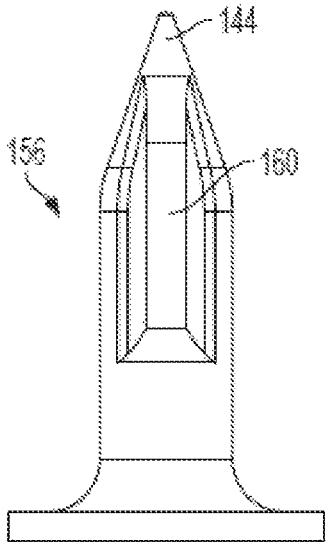
FIG. 3 is a side view of an example of a piercing member.
Figure 4:
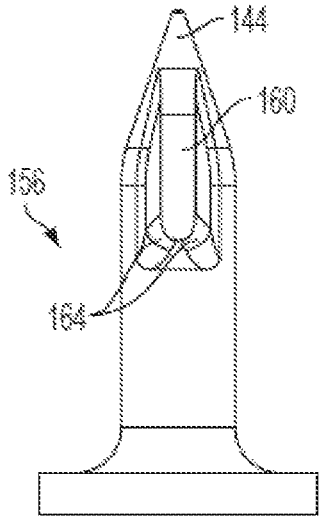
FIG. 4 is a side view of another example of a piercing member.

FIGS. 3 and 4 show two different embodiments for the geometry of the tip portion 156 of the piercing member 116. In both embodiments, the tip portion 156 includes two openings 160, spaced 180 degrees apart. As shown, the openings 160 are generally rectangular in cross section and elongated axially. However, in other embodiments, there may be any number of openings 160 equally or arbitrarily spaced from one another. Moreover, the openings 160 need not be identical and can vary.

As shown, the tip 144 of the piercing member 116 is generally triangular in cross section and intentionally blunt. This is in stark contrast to a traditional metal piercing member, which is very small in diameter and extremely sharp. The bluntness of the piercing member 116 helps to ensure that the piercing member 116 does not pre-maturely pierce the diaphragm 112 when the cartridge assembly 100 is in the inactivated position and the piercing member 116 engages the diaphragm 112.

As the cartridge assembly 100 is activated, the tip 144 of the piercing member 116 is forced through the pierceable diaphragm 112 until the openings 160 are in fluid communication with the pharmaceutical product. To increase the amount of flow through the openings 160, the piercing member 116 is designed such that in the activated position the openings 160 are entirely open to the pharmaceutical product.

In the inactivated position, the piercing member 116 exerts a force on the diagram 112 that moves the surface of the diaphragm out of its resting planar position. Also, due to the geometry of the piercing member 116, and the friction between the piercing member 116 and the diaphragm 112, the planar surface of the diaphragm 112 is further forced away from the resting plane during activation. Despite the resilient properties of the diaphragm 112, the diaphragm 112 tends to remain in a proximally flexed position even after activation (a "trampoline effect"). This is in contrast to a typical cartridge assembly wherein the sharp and narrow geometry of a metal piercing member causes little or no proximal displacement of the plane of the diaphragm 112 during and/or after activation.

The plastic cannula is understood to cause a blunt tear of the diaphragm upon activation instead of a piercing/cutting effect associated with a sharp metal piercing member. The trampoline effect can be minimized by elongating opening 160 to reduce the contact area and friction between the diaphragm 112 and piercing member 116 (see FIGS. 3 and 4). In addition, as shown in FIG. 4, distal end of the opening 160 include radial chamfers 164, which help to avoid the diaphragm 112 from catching on the corner of the opening 160.

The trampoline effect caused by the geometry and material properties of the plastic piercing member 116 and diaphragm 112 means that the amount of axial translation between the hub 114 and ampule 104 (measured from contact between the piercing member 116 and the diaphragm 112 in its resting planar position) in order to activate the cartridge assembly 100 is greater than that required to activate a traditional cartridge assembly with a metal piercing member that does not cause such a trampoline effect. To compensate for this additionally required axial movement, the hub 114 is configured such that the piercing member 116 proximally displaces with the diaphragm 112 in the inactivated position. By designing the hub 116 in this manner, the distance of the axial movement that the cartridge holder 102 must move ampule 104 is the same as an ampule with a hub having a traditional metal piercing member. This allows the hub 114 with the plastic piercing member 116 to be used with existing cartridge holders that are limited in the amount of axial translation between the hub and ampule.

As best shown in FIG. 2B, the distal end 148 of the male luer J 42 extends past a collar 150 of the distal connecting portion 120. In other embodiments, however, the distal end 148 of the luer 142 may be co-planer with the distal end of the collar 150 of the connecting portion 120 or may even terminate below the collar 150. The necked-down portion 124 connecting the proximal portion 130 and the distal connecting portion 120 includes four radially extending fins 152 that are evenly spaced around the circumference of the necked-down portion 124. These fins 152 help increase the structural integrity of the hub 114. Other embodiments of the hub 114 may include a different number of fins 152. As best shown in FIG. 2B, a fluid path 154 passes through the entire hub 114. The proximal portion of the fluid path 154 is defined by the lumen 118 of the piercing member 116.

It is important that the cartridge assembly 100 is provided to the medical professional in a sterile condition. The hub 114 and ampule 104 may be provided to medical professionals as separate pieces that have been sterilized independently or as a single cartridge assembly 100, with the hub 114 and ampule 104 being sterilized and then assembled in a sterile environment or assembled and then sterilized together.

In one aspect, the ampules and injector systems by autoclaving, which typically uses a high pressure steam environment at about 121 degrees Celsius for at least about 15 minutes. While the autoclaving process is useful for sterilizing cartridge assemblies, the heat associated with the autoclaving process can cause the diaphragm 112 of the ampule 104 to expand distally due to an increase in pressure within the ampule 104. In traditional cartridge assemblies with a metal piercing member, this distal expansion can cause premature piercing of the diaphragm. In addition to premature piercing, the heat associated with the autoclaving process may cause the metal piercing member to get so hot that it softens the plastic of the surrounding hub, which may result in the metal piercing member shifting within the plastic hub.

These problems associated with traditional cartridge assemblies are reduced or eliminated in the cartridge assembly 100 disclosed herein, which has a plastic piercing member 116. The plastic piercing member 116 is designed to interfere with the diaphragm 112 of the ampule 104 without penetrating the diaphragm and will not transfer heat to the surrounding components.

Figure 5A:
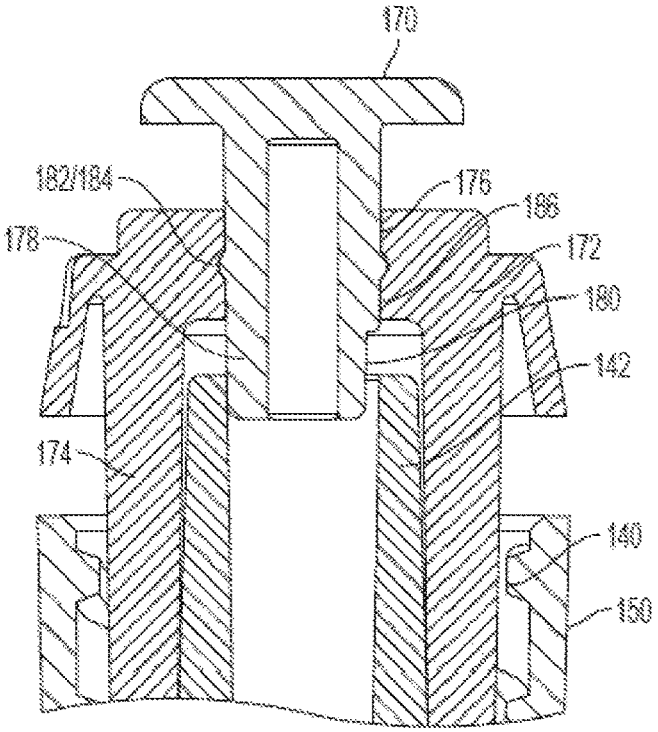
FIGS. 5A and 5B are cross sectional views of the distal end of an ampule with a protective sheath configured for autoclave sterilization (5A) and sterile packaging (5B).
Figure 5B:
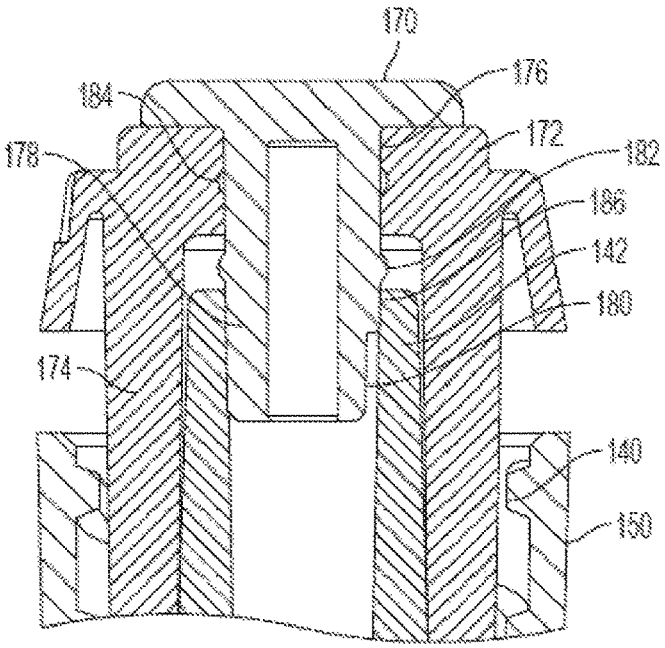

In addition, as shown in FIGS. 5A and 5B, in order to accommodate the autoclave sterilization of the ampule and maintain the sterility of the luer member 142 of the connecting portion 120, the luer member 142 may be fitted with a sheath 172, which includes plug 170. FIG. 5A shows the luer member 142 and sheath 172 in condition for autoclave sterilization. FIG. 5B shows the luer 142 and sheath 172 in condition for sterile packaging following autoclave sterilization. Sheath 172 includes sidewall 174 that fits snugly, but removably, between the luer member 142 and the threads 140 of the collar 150. The plug 170 fits through an opening 176 at the distal end of the sheath 172. The plug 170 includes a proximal portion 178 having an outer circumference that fits within the inner diameter of male luer 142. The outer circumference of the proximal portion 178 includes one or more interrupted portion(s) 180 that, curing autoclave sterilization, provide a venting with the interior of the male luer 142. As shown in FIG. 5A, detent 182 of the plug 170 maintains the plug 170 in a fixed position during autoclaving by engaging indent 184 of the sheath 172.

As shown in FIG. 5B, following the autoclaving process, the plug 170 is moved proximally into the opening 176 of the sheath 172 causing a central portion 186 of the plug 180 to move into the male luer 142. The central portion has an uninterrupted outer circumference, which sealingly engages the interior diameter of the male luer 142. The detent 182 is moved out of indent 184 and the male luer 142 is maintained in a sterile condition. The sheath 172 and the plug 170 are removed when they are to be connected to the appropriate fitting for delivery of the contents of ampule 100 to a patient. The sheath 170 and the plug 142 can be constructed of rigid or resilient plastic materials suitable for pharmaceutical applications. Dimensional interference between the sidewall 174, the threads 140 and the male luer 142, and between the outer circumference of central portion 186 and the interior diameter of the male luer provide for sealing but removeable engagement between the sheath 172, the plug 170 and the male luer 142.

Accordingly, in one aspect, the disclosure is directed to a method of providing a sterile cartridge assembly 100 for use in an injection system, for example for use with cartridge holder 102. The method may include: (i) providing a sealed ampule 104 containing a pharmaceutical product; (ii) providing a hub 114 comprising a plastic piercing member 116; (iii) connecting the ampule 104 to the hub 114 to create the cartridge assembly 100 without penetrating the diaphragm 112 of the ampule 104; and (iv) sterilizing the cartridge assembly 100 with an autoclaving process. During the autoclaving process, the plastic piercing member 116 will not penetrate the diaphragm 112. In addition, the assembly of the ampule and hub prior to sterilization may allow for the plastic piercing member 116 to apply force to the diaphragm 112 without piercing the diaphragm 112. Even in this preloaded condition, the piercing member 116 will not pierce the diaphragm 112 during the autoclaving process. Moreover, use of the plastic piercing member 116 avoids deformation of the structure in the hub 114 supporting the piercing member 116 during autoclaving.

Various examples of a cartridge assembly and corresponding method of providing a cartridge assembly for use with an injection system have been described above. Those skilled in the art will understand, however, that changes and modifications may be made to those examples without departing from the scope of the claims.

The invention claimed is:

1. A method of providing a sterilized cartridge assembly for use with an injection system, the method comprising:

providing a sealed ampule containing a pharmaceutical product; the sealed ampule having a pierceable diaphragm sealing the ampule at a distal end thereof, an end cap holding the pierceable diaphragm in place to define a distal portion of the sealed ampule, and a neck-down portion of the sealed ampule proximally adjacent the distal portion; the neck-down portion having a shoulder adjacent the distal portion of the sealed ampule and the end cap having an outer surface extending proximally from the distal end toward the shoulder;

forming an annular groove on the outer surface of the end cap;

providing a hub comprising a proximal portion defining a cavity configured to receive and engage the distal portion of the sealed ampule, the cavity including a radially inwardly facing annular bead for mating with and frictionally engaging the annular groove on the distal portion of the sealed ampule distal of the shoulder and limiting axial movement in both directions between the hub and the sealed ampule in a static initial inactivated position of the cartridge assembly, and a plastic piercing member fixed to the hub for piercing the pierceable diaphragm;

forming the hub and the plastic piercing member as two separate pieces of dissimilar plastic materials and fixing said two separate pieces together;

connecting the sealed ampule to the hub so that the annular bead frictionally engages the annular groove to define the static initial inactivated position of the cartridge assembly in which the hub is mounted on the sealed ampule, with the sealed ampule engaged and at rest due to the frictional engagement of the annular bead and the annular groove, and wherein the plastic piercing member contacts the pierceable diaphragm and applies a force that pushes a center of the pierceable diaphragm out of its resting plane so that the pierceable diaphragm is in a proximally flexed position, without causing the plastic piercing member to pierce the pierceable diaphragm of the sealed ampule, so as to define a static preloaded condition of the pierceable diaphragm and thus the cartridge assembly, and then;

autoclaving the cartridge assembly while the cartridge assembly is in the preloaded condition without causing the plastic piercing member to pierce the pierceable diaphragm of the sealed ampule.

2. The method of claim 1, wherein the annular bead has an inner diameter less than an outer diameter of the shoulder of the neck-down portion such that upon activation the annular bead moves out of engagement with the annular groove and in a proximal direction onto the neck-down portion where abutment of the annular bead with the shoulder limits movement of the hub back in a distal direction after activation.

3. The method of claim 1, wherein the plastic piercing member and the hub are fixed together with a two-shot molding process.

4. The method of claim 3, wherein the plastic piercing member and the hub are fixed together with a two-shot molding process comprising:

forming the plastic piercing member from a first polymeric material in an injection molding step, the plastic piercing member having a tip portion attached to a base portion; and forming the hub from a second polymeric material in another injection molding step;

wherein the first polymeric material is selected so as not to transfer heat to the hub during the autoclaving step.

5. The method of claim 1, wherein the plastic piercing member and the hub are fixed together with an overmolding process.

6. The method of claim 5, wherein the plastic piercing member is molded first and then the hub is overmolded onto the plastic piercing member.

7. The method of claim 5, wherein the hub is molded first and then the plastic piercing member is then overmolded onto the hub.

8. The method of claim 1, wherein forming the hub and the plastic piercing member as two separate pieces of dissimilar plastic materials comprises forming the plastic piercing member of a first polymeric material selected from a group of polymeric materials consisting of polymethyl methacrylate, polycarbonate, polyethylene terephthalate glycol (PETG), and an impact modified acrylic based multipolymer.

9. The method of claim 8, wherein forming the hub and the plastic piercing member as two separate pieces of dissimilar plastic materials comprises forming the hub of a second polymeric material selected from a group of polymeric materials consisting of polypropylene and a polyethylene based polymer.

10. The method of claim 1, wherein the plastic piercing member comprises a tip portion and a base portion for mounting the plastic piercing member into the hub, and the step of providing the plastic piercing member includes forming at least one axial movement limiting element on the base portion for engaging a mating axial movement limiting element on the hub to prevent the plastic piercing member from moving axially relative to the hub.

11. The method of claim 10, wherein the step of forming at least one axial limiting element on the base portion comprises forming a necked down portion defining a groove that mates with a tongue on the hub.

12. The method of claim 10, wherein forming the at least one axial limiting element on the base portion includes forming a plurality of protruding lugs configured to fit within a plurality of mating holes within the hub.

13. The method of claim 12, wherein pairs of the plurality of protruding lugs are arranged on opposite sides of the base portion of the plastic piercing member, each of the respective pairs being offset equidistance from a centerline of the base portion of the plastic piercing member.

14. The method of claim 13, wherein two pairs of protruding lugs are formed adjacent a proximal end of the base portion of the plastic piercing member and two pairs of protruding lugs are formed adjacent a distal end of the base portion of the plastic piercing member.

15. The method of claim 1, wherein the step of the plastic piercing member applying a force pushes the pierceable diaphragm proximally approximately 0.040 inches below its initial resting plane to define the static preloaded condition of the pierceable diaphragm without piercing the pierceable diaphragm in the static initial inactivated position of the cartridge assembly.

16. The method of claim 1, wherein the step of forming the hub and the plastic piercing member as two separate pieces of dissimilar plastic materials includes a step of adding silicone to the plastic material for plastic piercing member.

* * * * *